US005472050A

United States Patent [19]

Rhoten et al.

[11] Patent Number: 5,472,050

[45] Date of Patent: Dec. 5, 1995

[54] USE OF SEQUENTIAL FRACTURING AND CONTROLLED RELEASE OF PRESSURE TO ENHANCE PRODUCTION OF OIL FROM LOW PERMEABILITY FORMATIONS

[75] Inventors: Aaron T. Rhoten; Matthew A. Norris; Gregory S. Craley; Paul E. Crossman; Anthonius W. Vervloet, all of Bakersfield, Calif.

[73] Assignee: Union Oil Company of California, Los Angeles, Calif.

[21] Appl. No.: 305,084

[22] Filed: Sep. 13, 1994

[51] Int. Cl.[6] ..... E21B 43/26; E21B 47/06

[52] U.S. Cl. ..... 166/250.1; 166/53; 166/281; 166/297; 166/303; 166/308

[58] Field of Search ..... 166/250, 271, 166/281, 297, 308, 53, 64, 177, 303

[56] References Cited

U.S. PATENT DOCUMENTS

| | | | |
|---|---|---|---|
| 2,716,454 | 8/1955 | Abendroth | 166/308 |
| 2,927,638 | 3/1960 | Hall, Sr. | 166/308 X |
| 3,111,988 | 11/1963 | Davis et al. | 166/308 X |
| 3,136,361 | 6/1964 | Marx | 166/308 |
| 3,289,762 | 12/1966 | Schell et al. | 166/308 X |
| 3,709,295 | 1/1973 | Braunlich, Jr. et al. | 166/271 X |
| 4,167,470 | 9/1979 | Karnofsky . | |
| 4,265,310 | 5/1981 | Britton et al. | 166/271 X |
| 4,645,005 | 2/1987 | Ferguson | 166/278 |
| 4,828,031 | 5/1989 | Davis | 166/272 |
| 4,953,618 | 9/1990 | Hamid et al. | 166/53 X |
| 5,085,276 | 2/1992 | Rivas et al. | 166/303 |
| 5,271,465 | 12/1993 | Schmidt et al. | 166/297 |
| 5,305,829 | 4/1994 | Kumar | 166/271 X |

*Primary Examiner*—George A. Suchfield
*Attorney, Agent, or Firm*—Gregory F. Wirzbicki; Shlomo R. Frieman

[57] ABSTRACT

Hydrocarbon production from a low permeability formation is increased by fracturing a production interval in the formation and restricting the release of pressure from the fracture to lengthen the time that the reservoir pressure remains above the fracture collapse pressure.

49 Claims, 7 Drawing Sheets

USE OF SEQUENTIAL FRACTURING AND CONTROLLED RELEASE OF PRESSURE TO ENHANCE PRODUCTION OF OIL FROM LOW PERMEABILITY FORMATIONS

BACKGROUND

The present invention relates to the recovery of hydrocarbons (especially oil) from underground formations (particularly low permeability formations).

U.S. Pat. No. 5,085,276 ("Rivas") discloses the production of oil from low permeability formations by sequential steam fracturing. Rivas reports that "heating of the formation water and its 'flashing' from a liquid to a gas phase upon reducing wellbore pressures when returning to the production mode produces significantly increased quantities of oil from the formation to the wellbore." (Rivas, column 3, lines 39–44.) Furthermore, Rivas states that "the 'flashing' effect [continues] within the wellbore, as pressure therein reduces, thus aiding the flow of fluids to the surface for recovery from the wellbore." (Rivas, column 3, lines 44–47.)

SUMMARY OF THE INVENTION

Under current economic conditions, there is a need for a more efficient process for producing oil from low permeability formations.

The present invention satisfies this need by providing a processes where, after fracturing a production interval in a low permeability formation, the release of pressure from the fractured production interval is restricted (thus diminishing the difference between the reservoir and wellbore pressures) to lengthen the time that the reservoir pressure remains above the fracture collapse pressure. (As used in the specification and claims, the term "fracture collapse pressure" means the pressure inside a fracture below which the reservoir rock induces sufficient stress on the fracture to crush or imbed any discontinuities along the fracture face or any particles inside the fracture that might otherwise support the fracture in a partially or fully open state.) By reducing the difference between the reservoir and wellbore pressures, the present invention goes against accepted oil industry wisdom which is to maximize this pressure differential. More particularly, the established oil industry philosophy is based, inter alia, on Darcy's Equation which, for a radial reservoir under steady state conditions, can be represented by the following equation I $$q=kh(P_e-P_w)/\mu B\ln(r_e/r_w) \quad \text{(I)}$$

where q is the flow rate of produced fluids, k is the effective permeability of the reservoir, h is height of the perforated interval, $P_e$ is the reservoir pressure at the external boundary, $P_w$ is the wellbore pressure, $\mu$ is the viscosity of the produced fluids, B is a volume factor, $r_e$ is the external radius of the reservoir boundaries, and $r_w$ is the effective wellbore radius. Accordingly, those skilled in the art have attempted to maximize q, and thus production profits, by maximizing the difference between $P_e$ and $P_w$.

The concept of the present invention to minimize or diminish the difference between $P_e$ and $P_w$ is effective because, for a low permeability formation, the permeability k and the effective wellbore radius $r_w$ have a more dominant effect than the pressure differential between $P_e$ and $P_w$ on the overall production rate q through the life of a fracture stimulation cycle. More specifically, diminishing the difference between $P_e$ and $P_w$ lengthens the time that the reservoir pressure remains above the fracture collapse pressure (i.e., lengthens the time that the reservoir fracture remains open). Thus, since the effective permeability k and the effective wellbore radius $r_w$ of a low permeability formation is larger when the formation is fractured, the longer the fracture is held in an open condition, the longer a higher rate q of oil production can be sustained, all other factors being equal. The overall effect is that more oil can be produced per production cycle. Furthermore, the process of the present invention favorably alters reservoir compressibility, thereby allowing more production cycles to be run per production interval and, thus, making the process economics very favorable.

In one embodiment of the present invention, steam is employed to fracture a production interval in the low permeability formation and the oil is produced from the fractured interval while using a control valve to maintain the temperature and pressure upstream of the valve at levels where steam does not form. (As used in the specification and claims, the term "upstream" means in the direction opposite to the flow of a hydrocarbon (e.g., oil, natural gas) produced or producible from a well; and the term "downstream" means in the direction of the flow of a hydrocarbon produced or producible from a well.) Accordingly, in this version of the invention, the change in pressure in the wellbore and formation is controlled to prevent flashing from a liquid to a gas phase upstream of the control valve, which lengthens the time that the reservoir stays above the fracture collapse pressure.

In another embodiment, a liquid (e.g., water) and/or a gas (e.g., an inert gas) is employed to fracture the low permeability formation, and the oil is produced from the fractured formation while using a control valve to restrict the release of pressure from the fractured formation, thereby lengthening the time that the reservoir pressure remains above the fracture collapse pressure.

In all of the above embodiments, the oil is produced either with and/or without the aid of artificial lift (e.g., a pump).

DRAWINGS

The oil recovery methodology as well as other features, aspects, and advantages of the present invention will be better understood with reference to the following description, appended claims, and figures where like reference numerals refer to like elements and:

DETAILED DESCRIPTION OF THE INVENTION

Figure 1:
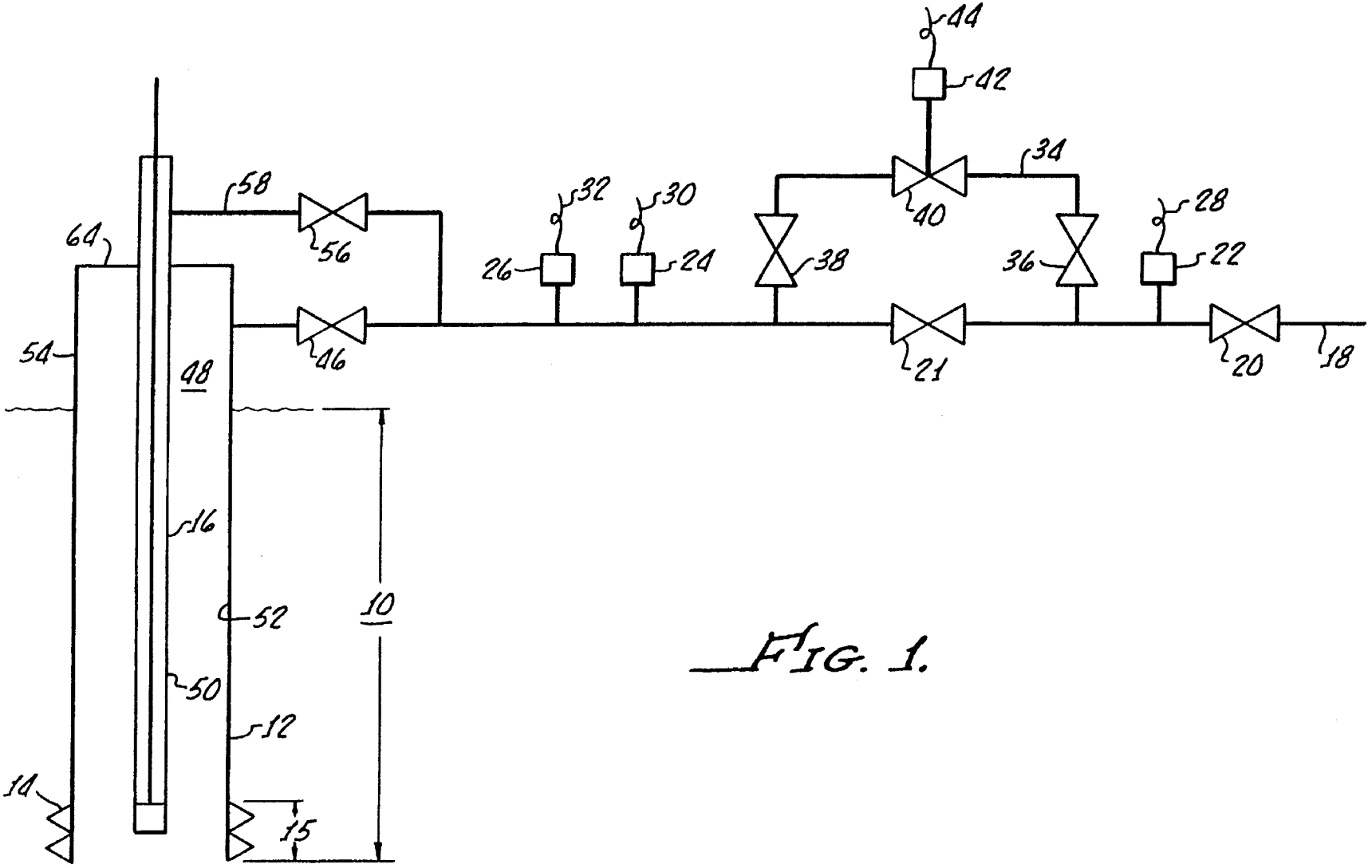
FIG. 1 is a schematic diagram of an oil recovery process embodying features of the present invention and configured to produce oil from a first oil production interval.

Referring to FIG. 1, the first step in producing oil from a formation 10 is to drill a wellbore 12 which penetrates the formation. The formation 10 is preferably a low permeability formation, i.e., a formation having an air permeability less than about 100 md. For example, the air permeability of the formation can be 75, 50, 25, 10, 5, 1, or 0.1 md or less. Low permeability formations include, but are not limited to, sandstone, diatomite, carbonate (e.g., limestone, dolomite), shale, coal, and chert formations.

A first set of randomly oriented perforations 14 is formed at a production interval 15 of interest in the formation 10. The perforations 14 are accomplished using methods and tools (e.g., Schlumberger's UltraJet Gun) well known to those skilled in the art. The length of the perforation interval 15 is dependent upon the reservoir porosity, permeability, and oil saturation. Primarily, core sample analyses or logs can be used to determine the intervals to be benefited most from the selective sequential fracturing and controlled pressure release methods of the present invention. The principle consideration is to perforate and fracture only that portion of the formation that can be effectively fractured at one time. To attempt more at one time may result in by-passed intervals and poor oil recovery. Typically, the perforation interval 15 is about 50 to about 150, and more typically about 75 to about 125, feet long.

After the first set of perforations 14 has been made, a tubing 16 is set in the wellbore 12. (Generally no packer is used in the process of the present invention.) With the tubing 16 run-in and set, a fracturing fluid is flowed in a conduit 18 from a fracturing fluid source (not shown) through open, manual valves 20 and 21.

The fracturing fluid employed in the present invention is preferably steam, water, or an inert gas (e.g., helium, neon, nitrogen, argon, and/or carbon dioxide). When the oil to be recovered from the formation has an API gravity of 20 degrees or less, the fracturing fluid generally has an elevated temperature (e.g., 100° C. (212° F.) or above) to help reduce the viscosity of the oil. However, when the oil has an API gravity greater than 20 degrees, the temperature of the fracturing fluid commonly is the same as, or close to, the ambient temperature (e.g., less than 100° C. (212° F.)).

The fracturing fluid optionally comprises a proppant (e.g., sand, aluminum, glass beads, nutshells, bauxite, ceramics, and/or plastics). When a proppant is used, it is usually employed in only one (and normally the first) of a plurality of fracturing cycles per fractured production interval.

As the fracturing fluid traverses the conduit 18, the fluid passes pressure transducers 22 and 24 and a temperature transmitter 26. The pressure transducers 22 and 24 and temperature transmitter 26 are connected to a power source (not shown) and a programmable logic controller ("PLC"; i.e., an industrial computer; not shown) by cables 28, 30, and 32, respectively. In addition, the fracturing fluid passes a bypass conduit 34 which, during the fracturing cycle, is isolated from the conduit 18 by closed, manual valves 36 and 38. Also along the bypass conduit 34 is an automated control valve 40 which is adjusted by an actuator 42 connected by a cable 44 to the power source and the PLC.

The fracturing fluid can enter the wellbore 12 in several ways. In one instance, the fracturing fluid enters the wellbore 12 by passing through an opened, manual valve 46 and into the annular space 48 between the outside surface 50 of the tubing 16 and the inside surface 52 of a casing 54 set in the wellbore 12. In this instance, a manual valve 56 in a conduit 58 is closed. In another instance, the valve 46 in the conduit 18 is closed and the valve 56 in the conduit 58 is opened. In this case, the fracturing fluid flows in the conduit 58 and through the opened, manual valve 56 and enters the wellbore 12 through the tubing 16. In a third scenario, both valves 46 and 56 are opened and the fracturing fluid enters the wellbore through both the tubing 16 and the wellbore annular space 48.

Regardless of what entry path is used for the fracturing fluid, the fracturing fluid is introduced into the wellbore 12 at a sufficient pressure to create a fracture (not shown) in the formation adjacent to the first set of perforations 14. Typically, the amount of fracturing fluid employed per cycle is between 1,000 to about 10,000, preferably about 2,000 to about 8,000, and most preferably about 3,000 to about 5,000, liquid barrels or their equivalent if steam or gas are used. Following the first fracturing cycle on the first set of perforations 14, the flow of fracturing fluid is stopped and the valves 20, 46 (if open), and 56 (if open) are manually closed. Next, the conduit 18 is placed in fluid communication with oil production facilities such as separators (not shown), storage tanks (not shown), flow meters (not shown), and the like. Then, the manual valves 36 and 38 in bypass line 34 are fully opened, while barely opening the automated control valve 40. The manual valve 21 is next closed, followed by the sequential opening of the valves 20 and 46 and/or 56.

The oil is generally initially produced from the fractured formation without using a pump. In addition, the pressure at which the oil is first produced during the production cycle usually equals or exceeds the pressure required to propagate a fracture in the production interval.

The pressure required to propagate a fracture in the production interval is referred to by those skilled in the art as the fracture pressure of the production interval. For any given production interval, the fracture pressure exceeds the fracture closure pressure, which in turn exceeds the fracture collapse pressure, for that production interval.

While the fracture pressure, the fracture closure pressure, and the fracture collapse pressure cannot be measured directly, they can be estimated. For example, the fracture pressure and the fracture closure pressure can be found by performing a step-rate pressure buildup test and a pressure fall off test, respectively, as described in Economides et al., *Reservoir Stimulation*, Schlumberger Educational Series, Houston, Tex. (1987), this publication being incorporated herein in its entirety by reference. In addition, the fracture collapse pressure can be estimated using the hypothesis that this pressure is roughly the pressure in the wellbore 12 at the midpoint of the perforations 14 when the rate of fluid produced from the wellbore 12 decreases to about 20 bopd.

Figure 4A:
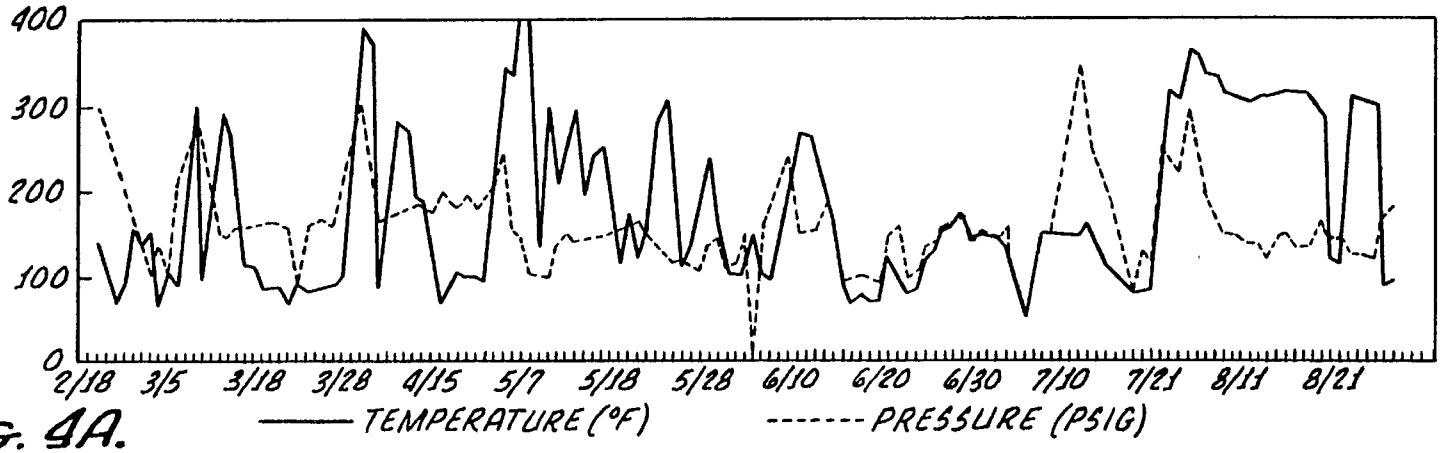
FIG. 4A is plot of temperature and pressure versus time for a well produced over a number of cycles in accordance with the present invention as described in Example 1.
Figure 4B:
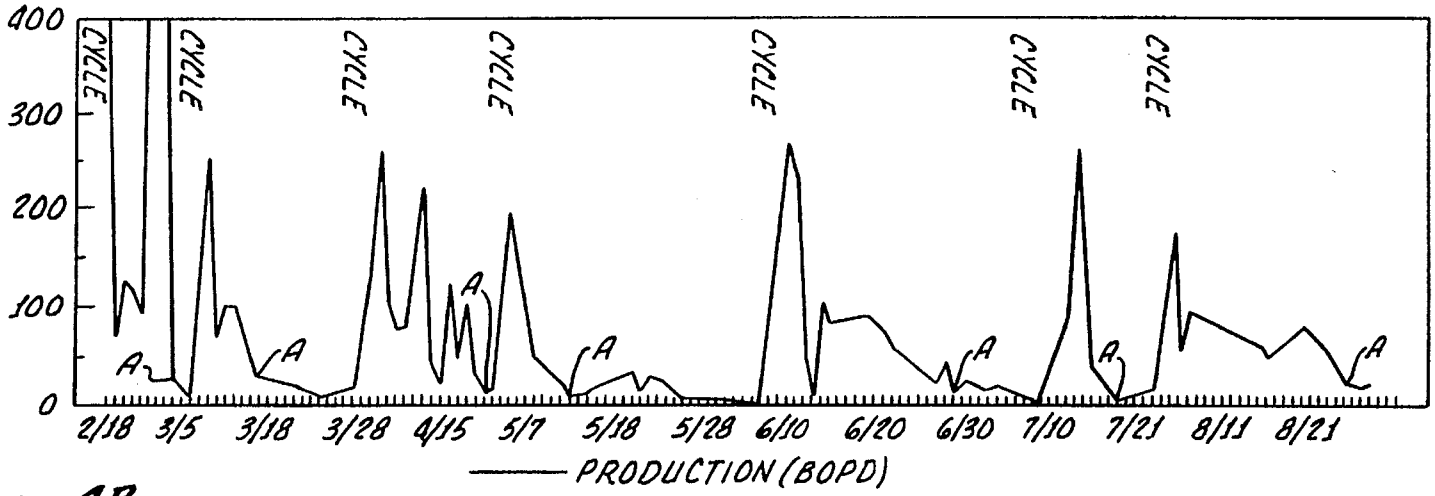
FIG. 4B is plot of oil production versus time for a well produced over a number of cycles in accordance with the present invention as described in Example 1.

Alternatively, the fracture collapse pressure can be estimated based on the assumption that this pressure is approximately the pressure in the wellbore 12 at the midpoint of the perforations 14 when the amount of oil produced per day abruptly shifts to a relatively constant, low rate (e.g., the sharp shifts marked A in FIG. 4B).

One of the keys to the enhanced performance of the method of the present invention is that the release of pressure from the fractured first interval 15 of the formation 10 is restricted to lengthen the time that the reservoir pressure remains above the fracture collapse pressure. In other words, an underlying principle of the invention is to produce oil at an economic rate (typically about 50 to about 500, and more typically about 50 to about 300, barrels of oil per day (bopd)) while minimizing or reducing the rate of pressure change at any location between the fractured interval 15 of the formation 10 and the upstream side of the control valve 40. For example, the change or decrease in pressure in the fractured interval 15 during a 24 hour interval in the hydrocarbon production cycle is generally less than about 50, preferably less than about 40, more preferably less than about 30, even more preferably less than about 25, and most preferably less than about 20 (e.g., about 15, 10, 5, etc. or less), percent, with the percent of change in pressure being calculated using the following equation II:

$$PC=\{(FP_{t=0}-FP_{t=24})/FP_{t=0}\}\cdot 100\% \quad \text{(II)}$$

where PC is the percent pressure change, $FP_{t=0}$ is the initial pressure in the fracture (i.e., at time 0 hours), and $FP_{t=24}$ is the pressure in the fracture after 24 hours. Alternatively, the approximate percent change in the pressure measured by the pressure transducer 24 and/or measured or estimated in the wellbore 12 at the midpoint of the perforations 14 are listed below in Table I.

TABLE I

| Percent Change In Pressure | | |
|---|---|---|
| | Location | |
| | PT 24[a] | Midpoint[b] |
| Generally | ≦50 | ≦50 |
| Preferred | ≦40 | ≦40 |
| More preferred | ≦30 | ≦30 |
| Even More preferred | ≦20 | ≦20 |
| Most preferred | ≦10 | ≦10 |

[a]PT 24 denotes pressure transducer 24 and the numbers represent the percent change in the pressure (PC) calculated by equation II using pressure measurements made by the pressure transducer 24 at the beginning and end of a 24 hour interval.

[b]Midpoint denotes in the midpoint of a production interval (e.g., the midpoint of the production interval 15) and the numbers represent the percent change in the pressure (PC) calculated by equation II using pressures measured or estimated in the wellbore 12 at the midpoint of the production interval being produced at the beginning and end of a 24 hour interval.

During any given production cycle, the percent change in pressure during a 24 hour period commonly remains within the above-stated limits at least about 50, more commonly at least about 70, even more commonly at least about 80, and most commonly at least about 90 (e.g., about 95, 99, etc. or more), percent of the duration of the production cycle. In fact, the percent change in pressure during a 24 hour period usually remains within the above-stated limits during the entire production cycle.

The pressure in the fractured interval 15 of the formation 10 can be approximated using the assumption that the pressure in the fractured interval 15 equals the pressure in the wellbore 12 at the perforations 14 plus the difference in pressure required to overcome friction losses in producing a fluid from the fractured interval 15 to the perforations 14. This relationship can be represented by the equation III $$P_{frac}=P_{wbave}+\Delta P_{fric1} \quad \text{(III)}$$

where $P_{frac}$ is the pressure in the fractured interval 15, $P_{wbave}$ is the average wellbore pressure, i.e., pressure in the wellbore 12 at the midpoint of the perforations 14, and $\Delta P_{fric1}$ is a frictional pressure drop, i.e., the difference in pressure between the pressure at a point in the fractured interval 15 and the pressure in the wellbore 12 at the midpoint of the perforations 14.

While friction loss can be calculated using Bernoulli's equation, at production rates of about 50 to about 500 bopd, the friction losses are often negligible and the pressure in the fracture interval 15 can be closely approximated by assuming that the pressure in the wellbore 12 at perforations 14 equals the pressure in the fracture interval 15. Accordingly, when the friction losses are negligible, equation III can be simplified to $$P_{frac}=P_{wbave} \quad \text{(IV)}$$

where $P_{frac}$ and $P_{wbave}$ are as defined above.

$P_{wbave}$ can be determined using different techniques. In one method, a pressure measurement device (not shown) can be inserted into the wellbore 12 across from the perforations 14. Usually, the pressure is measured with the device at the midpoint of the perforations 14 and time can be measured using the same device or with other supporting equipment (not shown). The measurements are recorded in digital or analog form and the recorded measurements are retrieved in real time or after the measuring device is retrieved from the wellbore 12.

Although the foregoing technique is the most accurate method for measuring $P_{wbave}$, this approach is impractical (i.e., too costly) for use on a wide scale, continuous basis. Accordingly, a more common technique entails estimating $P_{wbave}$ by first measuring the pressure in the well casing 54 at the surface, e.g., reading the pressure from the pressure transducer 24, which can be an analog or digital piece of equipment. If the pressure in the wellbore 12 is insufficient, by itself, to drive fluids to the surface, a measurement must also be made of the hydraulic head. This measurement is typically referred to as "shooting the fluid level." In addition, routine measurements to determine the makeup of the fluids produced from the wellbore 12 must be made using appropriate facilities (e.g., a separator; not shown) at the surface. $P_{wbave}$, and thus $P_{frac}$, can then be estimated using the following equation V $$P_{wbave}=P_{surf}+\Delta P_{fric2}+\Delta P_{grav} \quad \text{(V)}$$

where $P_{wbave}$ is as defined above, $P_{surf}$ is the pressure in the casing 54, e.g., as measured at the pressure transducer 24, $\Delta P_{fric2}$ is a frictional pressure drop, i.e., the difference in pressure between the pressure in the wellbore 12 at the midpoint of the perforations 14 and $P_{surf}$, and $\Delta P_{grav}$ equals $\rho\cdot g\cdot h$, with $\rho$ being the density of the produced fluid at its in situ pressure and temperature, g being the gravitational constant of the earth, and h being the true vertical distance from the point where $P_{surf}$ is measured to the midpoint of the perforations 14. When $\Delta P_{fric2}$ is negligible, equation V can be simplified to $$P_{wbave}=P_{surf}+\Delta P_{grav} \quad \text{(VI)}$$

where $P_{wbave}$, $P_{surf}$, and $\Delta P_{grav}$ are as defined above.

Different techniques can be used to lengthen the time that the reservoir pressure remains above the fracture collapse pressure by restricting the release of pressure from the fractured first interval 15 of the formation 10. An exemplary process is shown in FIG. 1 where the release of pressure is regulated by monitoring the pressure and/or temperature upstream of the control valve 40 using the pressure transducer 24 and/or the temperature transmitter 26, respectively, and feeding this information to the PLC which, based upon this information, then automatically adjusts the opening in control valve 40 via the actuator 42.

When the fracturing fluid is steam, the release of pressure during the oil production cycle is restricted so that generally, if not always, the water in the formation 10 and wellbore 12 does not flash to steam upstream of the control valve 40. To prevent the water from flashing in the formation 10 and wellbore 12 during the oil production cycle, the oil is produced from the formation 10 at a rate such that the temperature and pressure upstream of the control valve 40, e.g., in the vicinity of the pressure transducer 24 and the temperature transmitter 26, is maintained at a level where steam does not exist.

When the oil rate of flow approaches an uneconomical level, a pump (not shown) is activated to increase the production of oil from the tubing 16. During this stage, oil is produced via the wellbore annulus 48 due to the reservoir pressure and via the tubing 16 with the aid of the pump in a process referred to as "flumping". Later in the oil production cycle, oil ceases to be produced through the annulus 48 and is only produced through the tubing 16 due to the pumping action.

The oil-containing fluid produced with the aid of a pump is preferably transported past the pressure transducer 24 and the temperature transmitter 26 so that the temperature and pressure of the fluid can be monitored. The information obtained by the temperature transmitter 26 is used to restrict the release of pressure from the formation by regulating the rate at which oil is pumped from the formation. For example, the pump is deactivated when the temperature transmitter 26 senses that fluid temperature is at or over a preselect upper limit (e.g., about 148.9° C. (300° F.)) and reactivated when the temperature transmitter 26 senses that fluid temperature is at or below a preselect lower limit (e.g., about 100° C. (212° F.)). The pressure transducer 24 is used as backup system to turn the pump off in the event that the pressure approaches an excessive level, e.g. about 4238.165 kpascal (600 psi).

The first production cycle for the first perforated interval 15 is continued while the flow rate of the pumped oil is at or above an economical level.

In a second cycle of the first producing interval 15, the valves 36 and 38 in the bypass conduit 34 are manually closed and the wellbore 12 is again placed in fluid communication with the fracturing fluid source, and another fracturing cycle is begun at the first perforated interval 15. The amount of fracturing fluid is again in the range of between about 1,000 and 10,000 barrels of liquid or, if a gas, their liquid equivalent. After the second fracturing fluid injection step at the first interval 15, the flow is again modified to produce reservoir fluids to the surface through the wellbore 12 and/or the tubing 16. The number of fracturing and production cycle repetitions at a given interval is dependent upon local conditions, but generally is at least about 10, more typically at least about 20, and quite often about 30. In fact, even higher number of repetitions (e.g., about 40, 50, 60, 70, 80, 90, 100, and more) can be economically run per interval.

Figure 2:
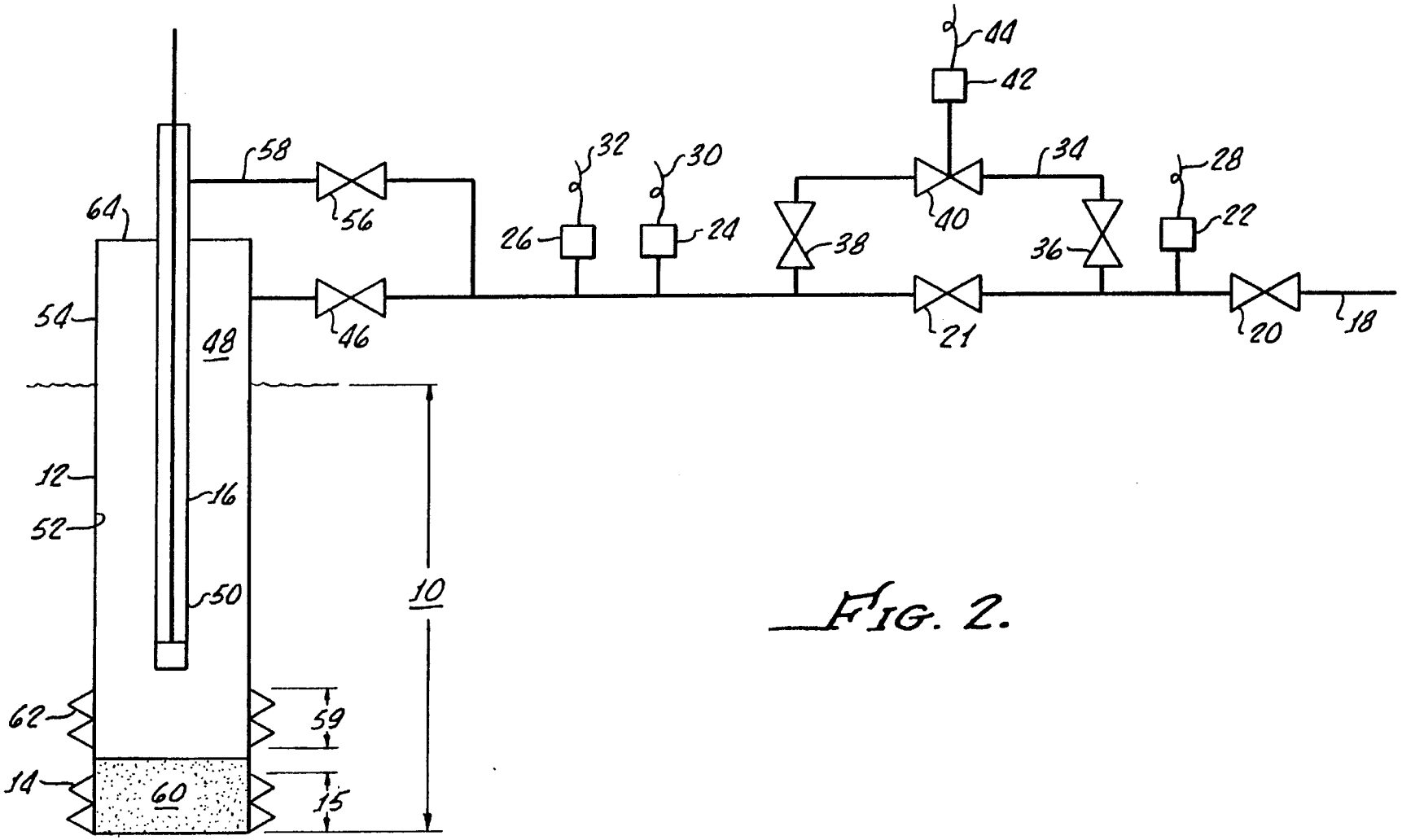
FIG. 2 is a schematic diagram of the same oil recovery process depicted in FIG. 1, but configured to produce oil from a second oil production interval.

Referring now to FIG. 2, after the first interval 15 has been economically depleted of oil, a second interval 59 within the formation 10 is selected for fracturing, based on open hole logs and wellbore cores. The tubing 16 is removed from the wellbore 12 and the second interval 59 to be perforated and fractured is preferably isolated by placing within the wellbore 12 a material 60 or an isolation device such as a bridge plug (not shown) which is substantially impervious to the fracturing fluid. Generally, the second production interval 59 (or subsequent production interval) is downstream of the first production interval 15 (or prior production interval) and in such instances the fracturing fluid impervious material 60 or device is positioned just below the second (or subsequent) interval 59. (Construction sand and a 5 to 10 feet cement cap form a satisfactory impervious material 12 when the fracturing fluid is steam.) Perforations 62 are formed at the second interval 59 using the casing perforation methods and tools described above. With the casing 54 now perforated at the second production interval 59, the tubing 16 is reset in the wellbore 12. Initially at the second interval 59, the fracturing fluid from the fracturing fluid source is flowed into the wellbore 12 by the methods described above with respect to fracturing the first interval 15. However, access to the first interval 15 is blocked by the fracturing fluid impervious material 60, thus forcing the fracturing fluid out of the perforations 62 in the second interval 59. The flow of fracturing fluid is continued until a predetermined volume of fluid has been displaced. Typically, the volume of fluid employed in fracturing the second (or subsequent) interval 59 is within the ranges mentioned above in connection with fracturing the first production interval 15. Next, oil is produced from the second interval 59, and the fracturing and production cycles are repeated, using techniques analogous to those employed for corresponding steps in the first interval 15.

The steps of locating a formation interval having potential to benefit from the selective fracturing-production techniques of the present invention may be repeated any number of times until the entire formation of interest has been accessed.

Figure 3:
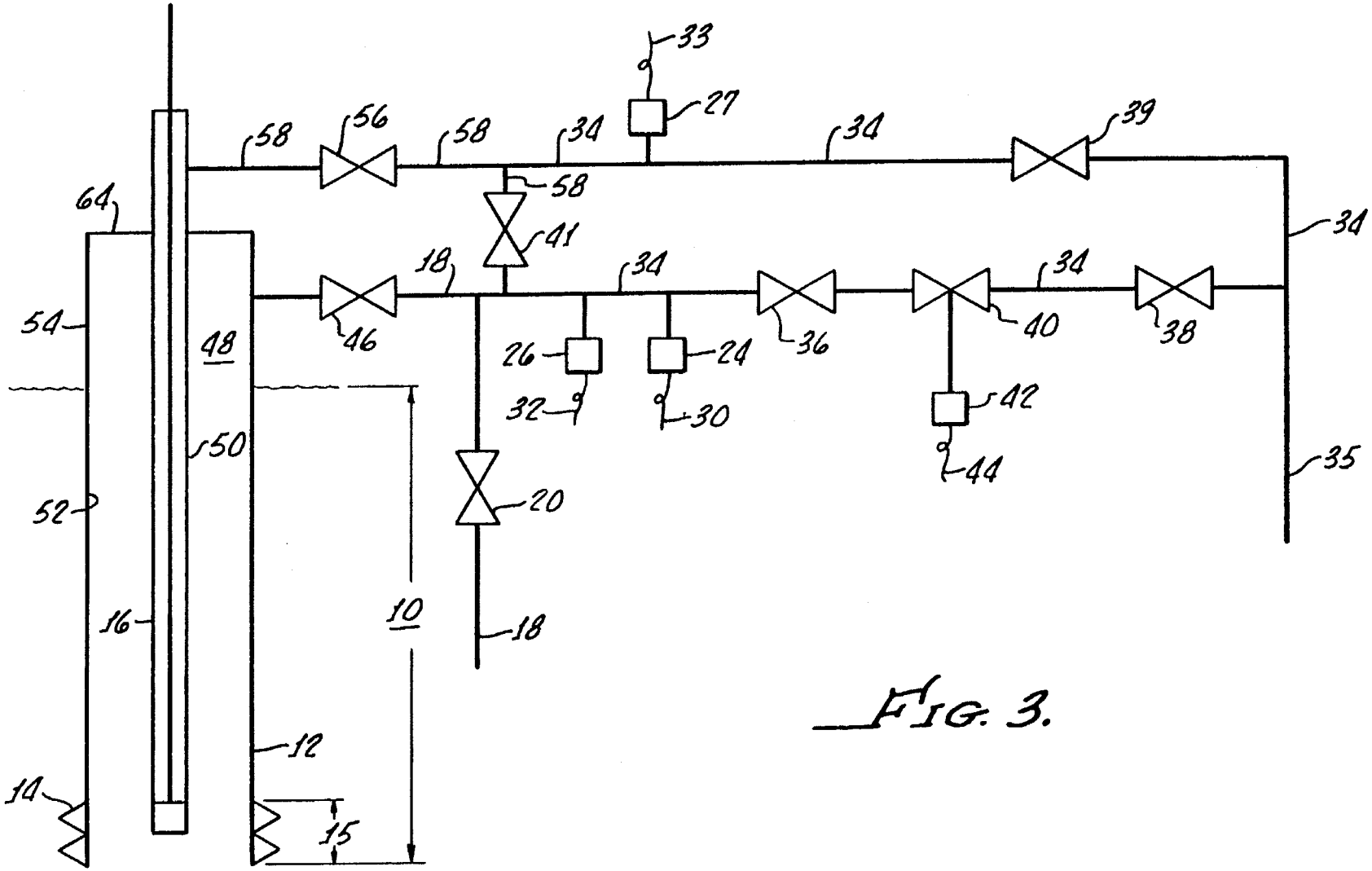
FIG. 3 is a schematic diagram of another oil recovery system embodying features of the present invention.

An alternative hydrocarbon production technique of the present invention is schematically shown in FIG. 3. After the first set of perforations 14 have been made and the tubing 16 set in the wellbore 12, a fracturing fluid is flowed in the conduit 18 from a fracturing fluid source (not shown) through the open, manual valve 20. In this version of the invention, manual valves 36, 38, and 39 in bypass conduit 34 are closed.

The fracturing fluid can enter the wellbore 12 in several ways. In one instance, the fracturing fluid enters the wellbore 12 by passing through an opened, manual valve 46 and into the annular space 48. In this instance, a manual valves 41 and 56 in a conduit 58 are closed. In another instance, the valve 46 in the conduit 18 is closed and the valves 41 and 56 in the conduit 58 are opened. In this case, the fracturing fluid flows in the conduit 58 and through the opened, manual valves 41 and 56 and enters the wellbore 12 through the tubing 16. In a third scenario, valves 41, 46, and 56 are opened and the fracturing fluid enters the wellbore through both the tubing 16 and the wellbore annular space 48.

After fracturing the formation adjacent to the first set of perforations 14, the flow of fracturing fluid is stopped and the valves 20, 41 (if open), 46 (if open), and 56 (if open) are manually closed. Next, the manual valves 36 and 38 in bypass line 34 of FIG. 3 are fully opened, while barely opening the automated control valve 40. Then, valves 46 and/or 41 and 56 are opened. When the temperature measured by a temperature transmitter 26 shows that the temperature of the produced fluid is below a predetermined level, the PLC (which is connected to the temperature transmitter 26 by a cable 32) activates a pump (not shown) to produce oil through the tubing 16.

The fluids produced by the pump can be handled in several ways. In one instance, the valve 41 is closed and the pumped fluids are transported along the conduit 58, through the valve 56 to the conduit 34, past a temperature transmitter 27, through an open manual valve 39, and into a conduit 35 for transit to a storage tank (not shown) or other fluid handling apparatus. The temperature transmitter 27 is connected to the PLC by a cable 33 and, in one version of the invention, the pump is turned on and off depending on whether the temperature measured by the temperature transmitter 27 is within an acceptable operating window.

In another version, the valve 39 is closed and the valve 41 is opened. In this embodiment, the pumped fluid commingles with the fluid rising in the annular region 48. The temperature of this combined fluid is measured by the temperature transmitter 26 and this information is used to regulate the flow through the automated control valve 40 as well as to activate and deactivate the pump.

The production cycle is continued as long as economically viable and then repeated in a manner analogous to that discussed above with respect to FIGS. 1 and 2.

EXAMPLES

The following examples, which are intended to illustrate and not limit the invention, detail various field runs employing processes within the scope of the present invention. More specifically, Example 1 summarizes a multicycle procedure where each cycle consisted of sequentially fracturing a production interval with steam and producing oil, while restricting the release of pressure, from the fractured interval. Each of Example 2–3 details a single cycle comprising fracturing a production interval with steam and restricting the release of pressure while producing oil from the fractured interval. Example 4 describes a single cycle comprising refracturing a propped fracture of a production interval with steam and restricting the release of pressure while producing oil from the fractured interval.

EXAMPLE 1

A production interval of an oil-bearing diatomite subterranean formation was fractured with steam having a steam quality of about 70 to about 80 percent and then produced while restricting the release of pressure, from the fractured interval. When the rate of oil production approached an uneconomical level the cycle was repeated. The six-complete cycles were run on the interval between Feb. 18 to Aug. 21, 1994 and the plots of temperature, pressure, and production versus time during this period are shown in FIG. 4A (temperature and pressure) and FIG. 4B (production).

The total volume of steam injected over the six cycles was about 3,510,937 $m^3$ (22,083 barrels) of cold water equivalent, with the amount of steam injected per cycle ranging from about 238.4823 $m^3$ (1,500 barrels) to about 715,447 $m^3$ (4,500 barrels) of cold water equivalent. Since about 1,682.413 $m^3$ (10,582 barrels) of oil were produced during these six cycles, the cumulative steam oil ratio (SOR) for the cycles was about 2.1.

EXAMPLE 2

Figure 5:
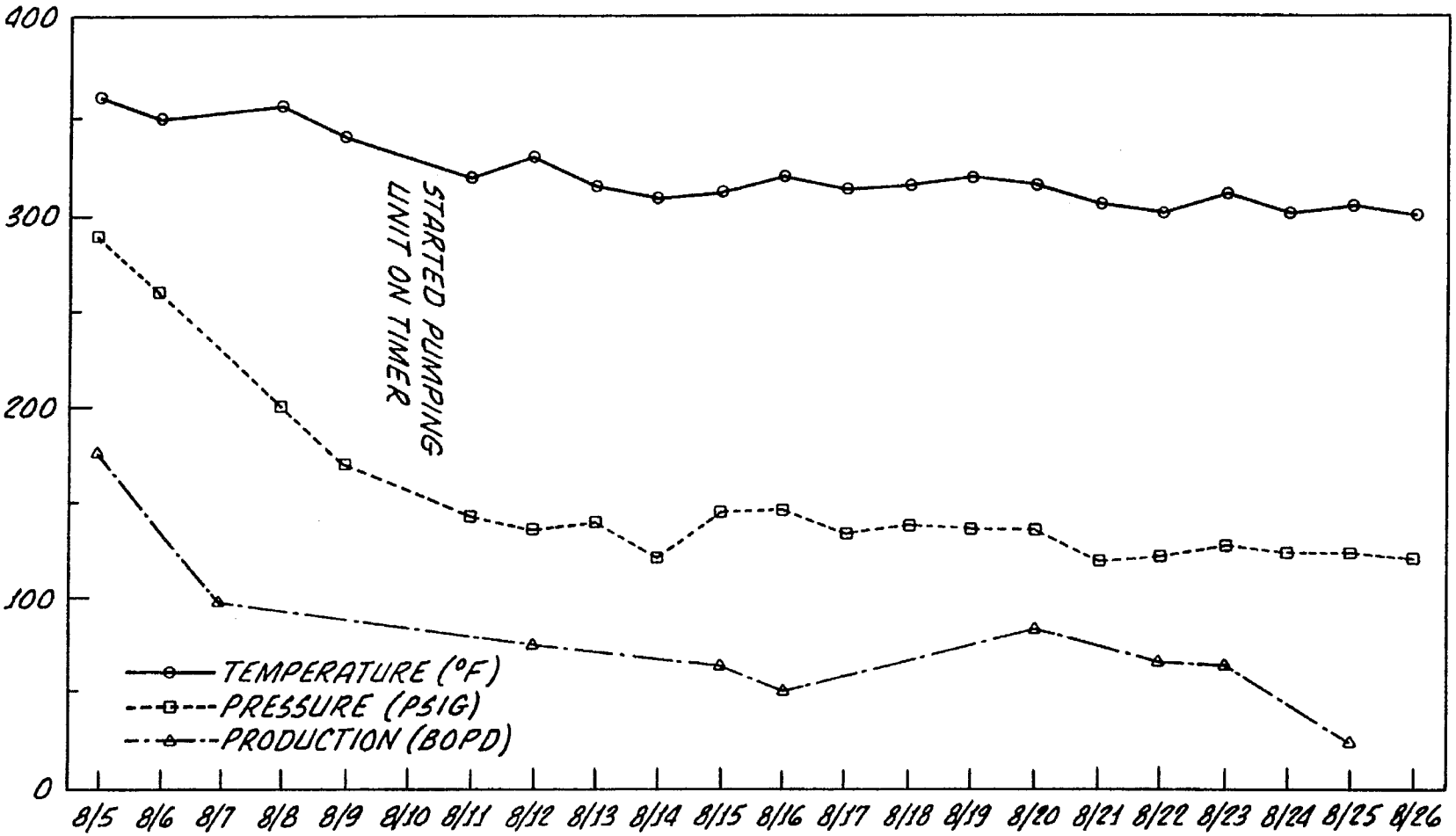
FIG. 5 is plot of temperature, pressure, and oil production versus time during a single cycle of a well produced in accordance with the present invention as described in Example 2.

A production interval of an oil-bearing diatomite subterranean formation was fractured by pumping steam (about 359.3134 $m^3$ (2260 barrels) cold water equivalent; steam quality was about 70 to about 80 percent) at a rate of about 128.7 liters per minute (34 gallons per minute) through a well and into the formation. The well was brought back on production while restricting the release of pressure from the formation and produced at the temperatures, pressures, and rates plotted in FIG. 5. During the cycle, the well yielded about 1784.887 (1100 barrels) of oil, thus giving an SOR of about 2.1.

EXAMPLE 3

Figure 6:
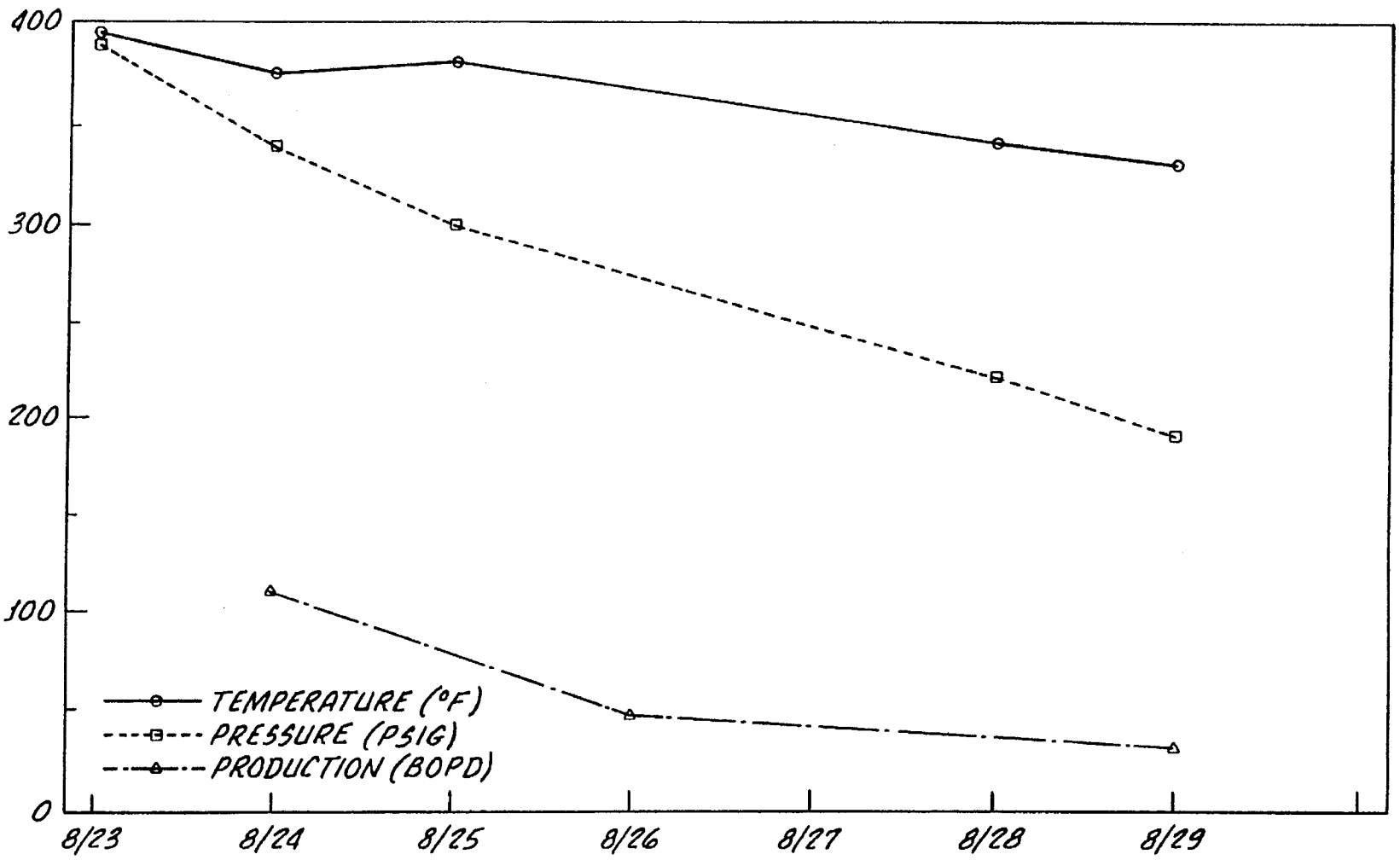
FIG. 6 is plot of temperature, pressure, and oil production versus time during a single cycle of a well produced in accordance with the present invention as described in Example 3.

A production interval of an oil-bearing diatomite subterranean formation was fractured by pumping low quality steam (about 375.6982 $m^3$ (2363 barrels) cold water equivalent; steam quality was about 10 to about 20 percent) at a rate of about 128.7 liters per minute (34 gallons per minute) through a well and into the formation. The well was brought back on production while restricting the release of pressure from the formation and produced at the temperatures, pressures, and rates plotted in FIG. 6. Over a period of about 7 days (the well was still flowing under its own pressure), the well produced about 63.59529 $m^3$ (400 barrels) of oil.

EXAMPLE 4

Figure 7:
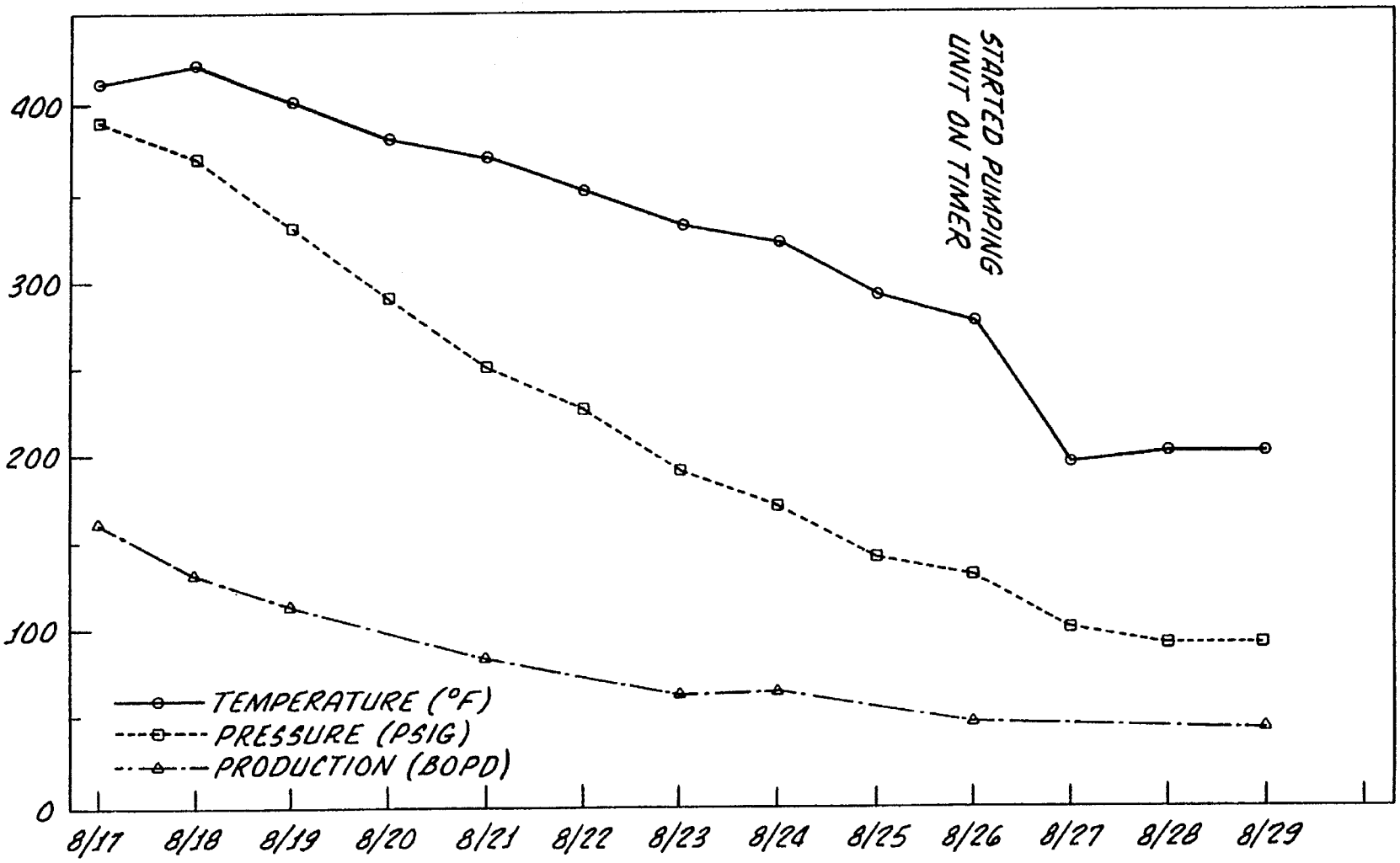
FIG. 7 is plot of temperature, pressure, and oil production versus time during a single cycle of a well produced in accordance with the present invention as described in Example 4.

A production interval of an oil-bearing diatomite subterranean formation was fractured and propped with sand. The propped fracture was re-fractured by injecting steam (about 378,074 $m^3$ (2378 barrels) cold water equivalent; steam quality was about 70 to about 80 percent) at a rate of about 128.7 liters per minute (34 gallons per minute) through a well and into the formation. The well was brought back on production while restricting the release of pressure from the formation and produced at the temperatures, pressures, and rates plotted in FIG. 7. During a period of about 13 days (about 10 days flowing and about 3 days pumping; the well was still being pumped to produce additional oil), the well produced about 114.3125 $m^3$ (719 barrels) of oil.

Although the present invention has been described in detail with reference to some preferred embodiments, other embodiments are possible. For example, valves 20, 36, 38, 39, 41, 46, and/or 56 could be automatic valves instead of manual ones. In addition, the control valve 40 can be located upstream of the well head 64. Therefore, the spirit and scope of the appended claims should not necessarily be limited to the description of the preferred versions contained herein.

What is claimed is:

1. A method for producing hydrocarbon from a hydrocarbon-containing subterranean formation, the method comprising the sequential steps of:

(a) fracturing at least a portion of the subterranean formation with a first fluid by injecting the first fluid into the subterranean formation through a well; and (b) producing the hydrocarbon from the formation through the same well while restricting the release of pressure from the formation fractured in step (a) to lengthen the time that the reservoir pressure remains above the fracture collapse pressure.

2. The method of claim 1 wherein the hydrocarbon comprises an oil.

3. The method of claim 1 wherein the hydrocarbon is an oil having an API gravity of 20 degrees or less.

4. The method of claim 1 wherein the hydrocarbon is an oil having an API gravity greater than 20 degrees.

5. The method of claim 1 wherein the fluid comprises steam.

6. The method of claim 1 wherein the fluid comprises water having a temperature at or above 100° C. (212° F.).

7. The method of claim 1 wherein the fluid comprises water having a temperature below 100° C. (212° F.).

8. The method of claim 1 wherein the fluid comprises a gas.

9. The method of claim 1 wherein the fluid comprises an inert gas.

10. The method of claim 1 wherein step (b) includes the step of initially producing the hydrocarbon at a pressure at or above the fracture pressure.

11. The method of claim 1 further comprising the sequential steps of:

(c) fracturing at least a portion of the subterranean formation with a second fluid by injecting the second fluid into the subterranean formation through the well; and (d) producing the hydrocarbon from the formation through the same well while restricting the release of pressure from the formation fractured in step (c) to lengthen time that the reservoir pressure remains above the fracture collapse pressure, wherein the first fluid further comprises a proppant.

12. The method of claim 11 wherein step (d) includes the step of initially producing the hydrocarbon at a pressure at or above the fracture pressure.

13. The method of claim 1 wherein the formation has a low permeability.

14. The method of claim 1 wherein the formation has a low permeability and is selected from the group consisting of sandstones, diatomites, carbonates, shales, coals, and cherts.

15. The method of claim 1 wherein steps (a) and (b) are repeated at least once.

16. The method of claim 1 wherein, prior to step (a), the method further comprising the sequential steps of:

(A) drilling and casing a wellbore which penetrates the subterranean formation; and (B) perforating the casing at a first production interval in the subterranean formation to form a first set of perforations; and step (a) includes the step of injecting the fluid through the first set of perforations to fracture at least a portion of the subterranean formation.

17. The method of claim 16 wherein during at least a portion of step (b) the percent change in pressure in the wellbore during a 24 hour interval is less than about 50 percent.

18. The method of claim 1 wherein step (b) includes the step of producing the hydrocarbon without the aid of artificial lift.

19. The method of claim 1 wherein step (b) includes the step of producing the hydrocarbon with the aid of artificial lift.

20. The method of claim 1 wherein step (b) includes the step of simultaneously producing a first portion of the hydrocarbon with the aid of artificial lift and producing a second portion of the hydrocarbon without the aid of artificial lift.

21. The method of claim 1 wherein step (b) includes the steps of producing the hydrocarbon with the aid of artificial lift, monitoring the temperature or pressure of the produced hydrocarbon, and using the monitored temperature or pressure information to regulate the rate at which the hydrocarbon is produced with the aid of the artificial lift.

22. The method of claim 1 wherein step (b) includes the steps of simultaneously producing a first portion of the hydrocarbon with the aid of artificial lift and producing a second portion of the hydrocarbon without the aid of artificial lift, monitoring the temperature or pressure of the first portion of the produced hydrocarbon, and using the monitored temperature or pressure information to regulate the rate at which the first portion of the hydrocarbon is produced with the aid of the artificial lift.

23. The method of claim 1 wherein during at least a portion of step (b) the decrease in pressure in the fractured part of the subterranean formation during a 24 hour interval is less than about 50 percent.

24. A method for producing hydrocarbon from a hydrocarbon-containing subterranean formation, the method comprising the sequential steps of:

(A) drilling and casing a wellbore which penetrates the subterranean formation;

(B) perforating the casing at a first production interval in the subterranean formation to form a first set of perforations;

(C) fracturing at least a portion of the subterranean formation with a first fluid by injecting the first fluid through the first set of perforations;

(D) producing the hydrocarbon from the formation through the first set of perforations while restricting the release of pressure from the formation fractured in step (C) to lengthen the time that the reservoir pressure remains above the fracture collapse pressure;

(E) isolating the first production interval within the wellbore with a material impervious to the first fluid;

(F) perforating the casing at a second production interval in the wellbore;

(G) fracturing at least a portion of the formation with a second fluid by injecting the second fluid through the second set of perforations to fracture at least a portion of the subterranean formation; and (H) producing the hydrocarbon from the formation through the second set of perforations while restricting the release of pressure from the formation fractured in step (G) to lengthen time that the reservoir pressure remains above the fracture collapse pressure.

25. The method of claim 24 wherein the first and second fluid are the same.

26. The method of claim 24 wherein the first and second fluid are different.

27. The method of claim 24 wherein step (H) includes the step of initially producing the hydrocarbon at a pressure at or above the fracture pressure.

28. The method of claim 24 wherein step (E) includes the step of isolating the first production interval within the wellbore with the first fluid impervious material at a level just above the first perforation and step (F) includes the step of perforating the casing at the second production interval in the wellbore downstream of the first fluid impervious material.

29. A method for producing oil from an oil-containing low permeability formation, the method comprising the steps of:

(a) fracturing at least a portion of the formation with steam; and (b) producing the oil from the fractured formation through a means for controlling liquid flow while maintaining the temperature and pressure on the upstream side of, and adjacent to the liquid flow control means, at levels where steam does not form.

30. The method of claim 29 wherein during step (b) the temperature on the upstream side of and adjacent to the liquid flow control means is maintained below that necessary to form steam at the pressure on the upstream side of and adjacent to the liquid flow control means.

31. The method of claim 29 wherein during step (b) the pressure on the upstream side of and adjacent to the liquid flow control means is maintained above that necessary to form steam at the temperature on the upstream side of and adjacent to the liquid flow control means.

32. The method of claim 29 wherein step (b) includes the step of producing the oil without flashing the steam upstream of the liquid flow-control means.

33. The method of claim 29 wherein the liquid flow control means is located upstream of the well head.

34. The method of claim 29 wherein the liquid flow control means is located downstream of the well head.

35. The method of claim 29 wherein during at least a portion of step (b) the percent change in pressure on the upstream side of, and adjacent to the liquid flow control means, is less than about 50 percent.

36. The method of claim 29 wherein during at least a portion of step (b) the pressure upstream of the liquid flow control means is monitored and, based upon the monitored information, the rate of flow of the produced oil through the liquid flow control means is adjusted.

37. The method of claim 29 wherein during at least a portion of step (b) the temperature upstream of the liquid flow control means is monitored and, based upon the monitored information, the rate of flow of the produced oil through the liquid flow control means is adjusted.

38. A method for producing oil from an oil-containing low permeability formation, the method comprising the steps of:

(a) fracturing at least a portion of the formation with a fluid selected from the group consisting of liquid water and gas by injecting the fluid into the subterranean formation through a well; and (b) producing oil from the formation through the same well while restricting the release of pressure from the formation fractured in step (a) to lengthen time that the reservoir pressure remains above the fracture collapse pressure.

39. The method of claim 38 wherein step (b) includes the step of initially producing the oil at a pressure at or above the fracture pressure.

40. The method of claim 38 wherein step (b) includes the step of restricting the release of pressure by producing the oil from the fractured formation through a means for controlling liquid flow so that the pressure drop from the fractured portion of the formation to the portion of a perforated wellbore in fluid communication with the fractured portion of the formation is less than about 90 percent of the pressure drop achievable if the liquid flow control means were set in an unrestricted mode.

41. The method of claim 38 wherein step (b) includes the step of restricting the release of pressure by producing the oil from the fractured formation through a means for controlling liquid flow so that the pressure drop from the fractured portion of the formation to the portion of a perforated wellbore in fluid communication with the fractured portion of the formation is less than about 50 psi.

42. The method of claim 38 wherein step (b) includes the step of restricting the release of pressure by producing the oil from the fractured formation through a means for controlling liquid flow so that the pressure drop from the portion of a perforated wellbore in fluid communication with the fractured portion of the formation to a location upstream of and adjacent to the liquid controlling means is less than about 90 percent of the pressure drop achievable if the liquid flow control means were set in an unrestricted mode.

43. A method for producing oil from an oil-containing, low permeability formation, the method comprising the sequential steps of:

(a) drilling and casing a wellbore which penetrates the subterranean formation;

(b) perforating the casing at a first production interval in the subterranean formation to form a first set of perforations;

(c) fracturing at least a portion of the formation with a first fluid by injecting the fluid through the first set of perforations to fracture at least a portion of the subterranean formation; and (d) producing oil from the formation through the first set of perforations while restricting the release of pressure from the formation fractured in step c) to lengthen the time that the reservoir pressure remains above the fracture collapse pressure.

44. The method of claim 43 wherein prior to step (c) a tubing is inserted in the casing and step (d) includes producing the oil through the annular space defined by the outside surface of the tubing and the inside surface of the casing.

45. The method of claim 43 wherein prior to step (c) a tubing is inserted in the casing and step (d) includes producing the oil through the tubing and the annular space defined by the outside surface of the tubing and the inside surface of the casing.

46. The method of claim 43 wherein prior to step (c) a tubing is inserted in the casing and step (d) includes producing the oil through the tubing.

47. The method of claim 43 wherein steps (c) and (d) are sequentially repeated a plurality of times.

48. The method of claim 43 further comprising the sequential steps of:

(e) isolating the first production interval within the wellbore with a material impervious to first fluid;

(f) perforating the casing at a second production interval in the wellbore;

(g) fracturing at least a portion of the formation with a second fluid by injecting the second fluid through the second set of perforations to fracture at least a portion of the subterranean formation; and (h) producing oil from the formation through the second set of perforations while restricting the release of pressure from the formation fractured in step (g) to lengthen the time that the reservoir pressure remains above the fracture collapse pressure.

49. A method for producing hydrocarbon from a hydrocarbon-containing subterranean formation, the method comprising the sequential steps of:

(a) fracturing at least a portion of the subterranean formation with a first fluid by injecting the first fluid into the subterranean formation through a well; and (b) producing the hydrocarbon from the formation through the same well while restricting the release of pressure from the formation fractured in step (a) to lengthen the time that the reservoir pressure remains above the fracture collapse pressure, wherein step (b) includes the steps of simultaneously producing a first portion of the hydrocarbon with the aid of artificial lift and producing a second portion of the hydrocarbon without the aid of artificial lift, commingling the first and second portions, monitoring the temperature or pressure of the commingled hydrocarbon fluids, and using the monitored temperature or pressure information to regulate the rate at which the first portion of the hydrocarbon is produced with the aid of the artificial lift.

* * * * *